US008317142B2

(12) United States Patent
Gallardo et al.

(10) Patent No.: US 8,317,142 B2
(45) Date of Patent: Nov. 27, 2012

(54) SHOWER BRACKET

(75) Inventors: Luis E. Gallardo, Vista, CA (US); Dennis Hart, Incline Village, NV (US)

(73) Assignee: Securus, Inc., San Diego, CA (US)

( * ) Notice: Subject to any disclaimer, the term of this patent is extended or adjusted under 35 U.S.C. 154(b) by 1135 days.

(21) Appl. No.: 12/175,684

(22) Filed: Jul. 18, 2008

(65) Prior Publication Data

US 2009/0026328 A1 Jan. 29, 2009

Related U.S. Application Data

(60) Provisional application No. 60/961,923, filed on Jul. 25, 2007.

(51) Int. Cl.
*A47B 96/06* (2006.01)

(52) U.S. Cl. ..... 248/212; 248/74.1; 248/74.2; 4/570; 239/282

(58) Field of Classification Search ..... 248/75, 248/200.1, 689, 611, 227.3, 227.4, 68.1, 248/61, 62, 63, 74.1, 74.2, 74.4; 4/570, 615; 239/282, 283
See application file for complete search history.

(56) References Cited

U.S. PATENT DOCUMENTS

| | | | | |
|---|---|---|---|---|
| 1,671,338 | A * | 5/1928 | Banks et al. | 248/694 |
| 1,956,526 | A * | 4/1934 | Ellmann | 174/155 |
| 2,355,742 | A * | 8/1944 | Morehouse | 248/68.1 |
| 3,054,587 | A * | 9/1962 | Hebenstreit et al. | 248/74.1 |
| 3,995,795 | A * | 12/1976 | Hogan | 248/68.1 |
| 5,133,094 | A * | 7/1992 | Clarke, Jr. | 248/68.1 |
| 5,257,768 | A * | 11/1993 | Juenemann et al. | 248/604 |
| 5,742,982 | A * | 4/1998 | Dodd et al. | 24/16 R |
| 6,126,119 | A * | 10/2000 | Giangrasso | 248/58 |
| 6,519,791 | B2 * | 2/2003 | Randolph | 4/695 |
| 6,595,473 | B2 * | 7/2003 | Aoki et al. | 248/74.4 |
| 7,770,848 | B2 * | 8/2010 | Johnson et al. | 248/65 |
| 7,770,850 | B2 * | 8/2010 | Allmann et al. | 248/68.1 |
| 2008/0191102 | A1 * | 8/2008 | Condon et al. | 248/67.7 |
| 2009/0045300 | A1 * | 2/2009 | Vander Griend | 248/62 |

FOREIGN PATENT DOCUMENTS

DE 202006006347 U1 * 7/2006

* cited by examiner

*Primary Examiner* — Kimberly Wood
(74) *Attorney, Agent, or Firm* — Stetina Brunda Garred & Brucker; Lowell Anderson

(57) ABSTRACT

A mounting bracket connects a water pipe fastened to an eared fitting to a support bar in a building. The bracket has an isolator made of a material selected to substantially reduce the transmission of noise and wrapped around the support bar. The bracket has a stiff shell wrapped around a periphery of the support bar and has two opposing ends. The shell is sized to clamp the isolator against the support bar during use as the ends are moved toward each other with sufficient force that there is a tight clamp resulting in little relative movement between the shell and the support during use. The shell has a mounting portion for the eared fitting. The bracket also has a fastening mechanism to hold the ends together and to fasten the eared fitting to the mounting portion during use of the bracket. The fastening mechanism clamps the ends together to restrain relative movement of the shell and support bar. For telescoping support bars an adaptor is interposed between the isolator and the smaller, inner telescoping member of the support bar to make the support bar a uniform size at the location of the bracket.

23 Claims, 9 Drawing Sheets

96
92
84
96
92
96
96
96

84
96
92
96
92
96
94
82b
82a 94
82a
84
76
82b
94
86

76
82a 76
82b 94
82a
92
86
94
82b
86
86
86
94

82a
94
94
82b
86

SHOWER BRACKET

CROSS-REFERENCE TO RELATED APPLICATIONS

The present application claims priority to U.S. provisional patent application No. 60/961,923 which was filed on Jul. 25, 2007.

BACKGROUND

Many bathrooms have showers and the showerheads for those showers are held in place by fastening the water pipe leading to the showerhead to a cross-member extending between studs in the home or building containing the shower. The connection between the showerhead and the water pipe must be strong since users will sometimes pull on the showerhead. But providing a sufficiently strong connection results in vibrations from the water pipe being transmitted directly to the cross-member and building studs and that in turn can transmit or amplify vibrations and noise from the water pipe throughout the building. There is thus a need for an improved mounting mechanism that reduces this noise.

Further, current brackets are often difficult to accurate and easily locate at the same place as the water pipe leading to the showerhead. There is thus a need for an improved mechanism to hold the pipe leading to the showerhead while providing an adjustable position.

BRIEF SUMMARY

A first layer of sound absorbing material (an isolator) is placed around a support member which is preferably of adjustable length, with a stiff supporting shell placed around the outside of the first layer of sound absorbing material and clamped tightly to the support member so the shell does not move. The supporting shell and first layer are preferably configured to have interlocking portions to hold the shell and first layer together. Preferably, the first layer or isolator is of molded plastic with prongs or recesses located to mate with corresponding recesses or prongs in the shell to form one of several types of an interlocking connections that holds the isolator to the stiff shell. The shell fastens to the support member and preferably encircles and clamps around a portion of the support member with the isolator interposed between the shell and the support member. The shell is configured to support the pipe leading to the showerhead, typically by having a fastening portion adapted to mate with an eared fitting commonly used with shower heads and water pipes. The first layer or isolator absorbs and isolates vibrations in the water pipe so they are not transmitted to the support member and the shell provides a sturdy support for the water pipe and shower head, preferably reducing the transmitted vibrations by about 50% to as much as about 90% or more.

In one preferred embodiment there is provided a shower mounting bracket for connecting an eared fitting to an elongated support bar having a generally rectangular cross-section with a top and sides and extending between studs of a building. The eared fitting is configured to connect to a shower head and water pipe. The bracket includes a stiff outer shell having a body portion with sides long enough to extend around and along the top and sides of the support bar during use of the bracket. The shell has first and second ends at least one of which has first openings therein located in a mounting portion configured to fasten to the eared bracket during use. The first openings are further located to receive threaded fasteners extending through the eared fitting during use of the bracket. The bracket also has an isolator sized to fit between the body portion and the support bar during use where the isolator is made of a material that substantially reduces the transmission of sound. The bracket also has a mechanism fastening the shell ends together with the shell being sized slightly smaller than the adjacent support bar and intervening isolator so that when the ends are fastened together the isolator can be tightly clamped to the support.

In further variations of this embodiment the shell has sides generally parallel with each side of the support and the ends are generally parallel with each other during use. Further, the bracket can optionally include a releasable latch to hold the first and second ends together. The releasable latch advantageously includes a male portion of a snap lock located on one end and a female portion of a snap lock located on the other end, the male and female portions being located to align and releasably engage during use to loosely hold the bracket in position relative to the support. Moreover, the bracket optionally has the isolator fastened to the shell to restrain relative movement of the isolator and shell. Additionally the isolator and shell can have different mating parts of a snap lock comprising at least one projection and at least one recess engaging to hold the isolator in position relative to the shell. Advantageously there are a plurality of ribs on an inside surface of the isolator. Further, the first end of the shell optionally has a metal insert with at least one slot located to receive a threaded fastener passing through the eared fitting. The metal insert is preferably, but optionally over-molded with plastic with two spaced apart slots each located to receive a different threaded fastener passing through the eared fitting, and the second end also has two slots located to align with the slots in the first end. The mounting bracket also optionally uses a shell that is a substantially flat sheet of material containing the first end with the second end offset from but parallel to the sheet of material, with the sheet of material having a reduced thickness along at least two fold lines corresponding to the corners of the support during use.

A further embodiment of the bracket is also provided for connecting a water pipe fastened to an eared fitting to a support bar in a building. This further embodiment has an isolator made of a material selected to substantially reduce the transmission of noise and has a length sufficient to wrap around the support bar. This further embodiment has a stiff shell sized to wrap around a periphery of the support bar and has two ends. The shell is sized to clamp the isolator against the support bar during use as the ends are moved toward each other, the clamping occurring with sufficient force that there is a tight clamp resulting in little relative movement between the shell and the support during use. The shell has a mounting portion for the eared fitting and a fastening mechanism to hold the ends together and to also fasten the eared fitting to the mounting portion during use of the bracket.

This further embodiment preferably, but optionally has a support bar has four sides and the isolator has sides long enough to wrap around four sides of the support bar during use. The isolator also has outwardly extending flanges along at least a portion of each side, and the outer shell also has a body portion with sides sized to fit between opposing flanges of the isolator.

In further variations of this embodiment the shell has sides with hinges extending from side-to-side and spaced apart a distance sufficient to align with the corners of the support bar during use, with the first and second ends being parallel during use. The fastening mechanism optionally comprises at least one aligned slot in the first and second ends with a threaded fastener extending through the slots. Advantageously the bracket also has male and female portions of a snap-lock with each portion located on a different end. Preferably the shell and isolator are held together by a plurality of interlocking mechanisms located on the isolator and shell.

A still further embodiment of the mounting bracket has isolator means for surrounding a portion of the support bar with a sound deadening material during use and shell means for urging the isolator means against the support bar during use. This still further embodiment also has clamp means for tightly clamping the shell means and isolator means against the support bar during use to allow only a little movement of the shell means relative to the support bar during use.

Optionally, this still further embodiment includes a snap-lock for releasably and loosely holding the bracket on the support bar during use to allow movement along a length of the support bar. Means are also optionally provided for restraining relative movement between the isolator means and the shell means.

Each of the above embodiments is also optionally used with a support bar that is telescoping and has a plurality of apertures in the support bar. Use with this telescoping support bar is made easier by providing an adaptor having a U-shaped cross section and a thickness about that of a thickness of one wall of the support bar. The adaptor has projections extending toward an inside of the adaptor and located to engage the apertures in the support bar during use. The adaptor is interposed between the isolator means and the support bar during use.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
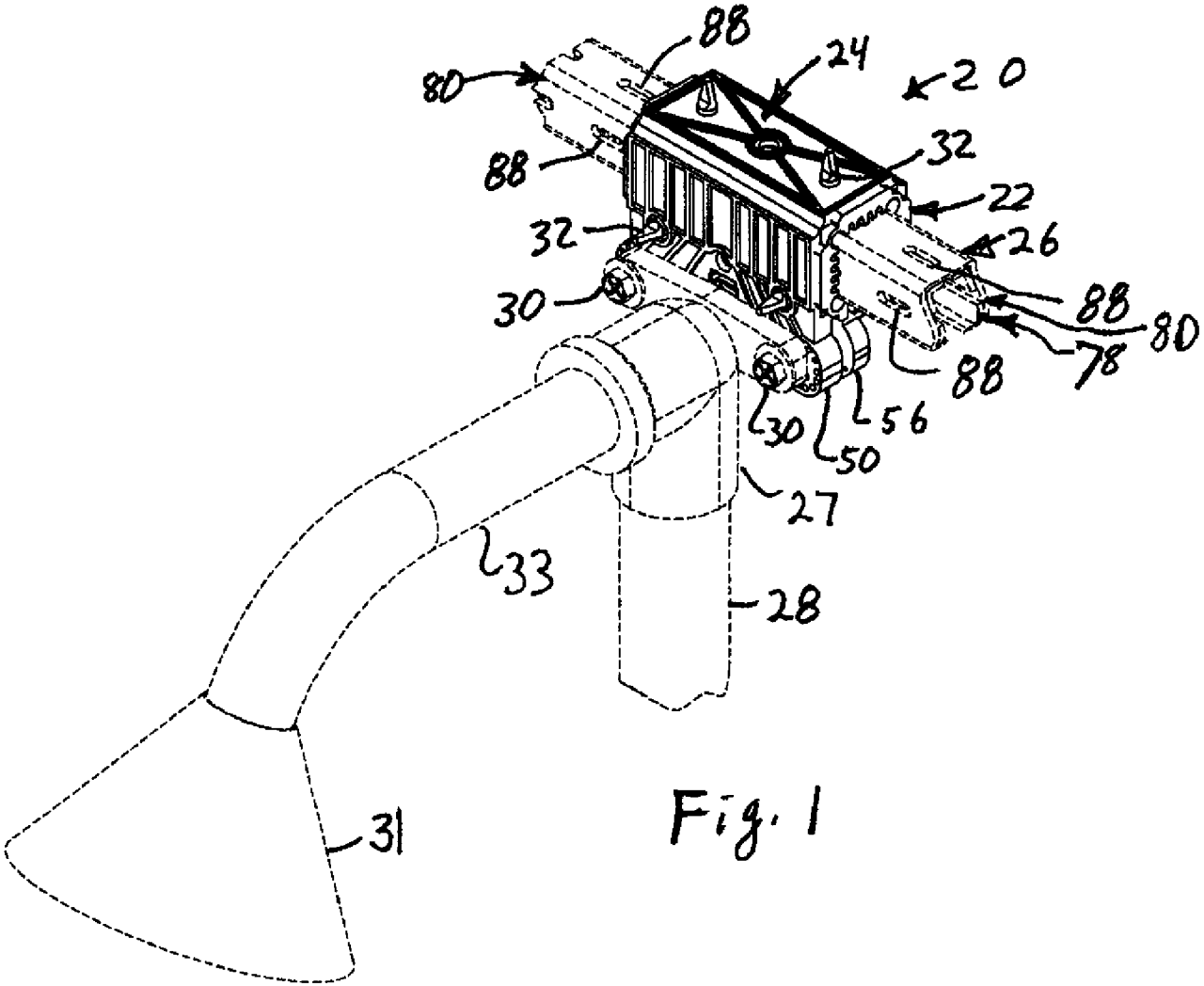
FIG. 1 is a perspective view of a shower bracket mounted an adjustable support bar with a water pipe fastened to the bracket.
Figure 2A:
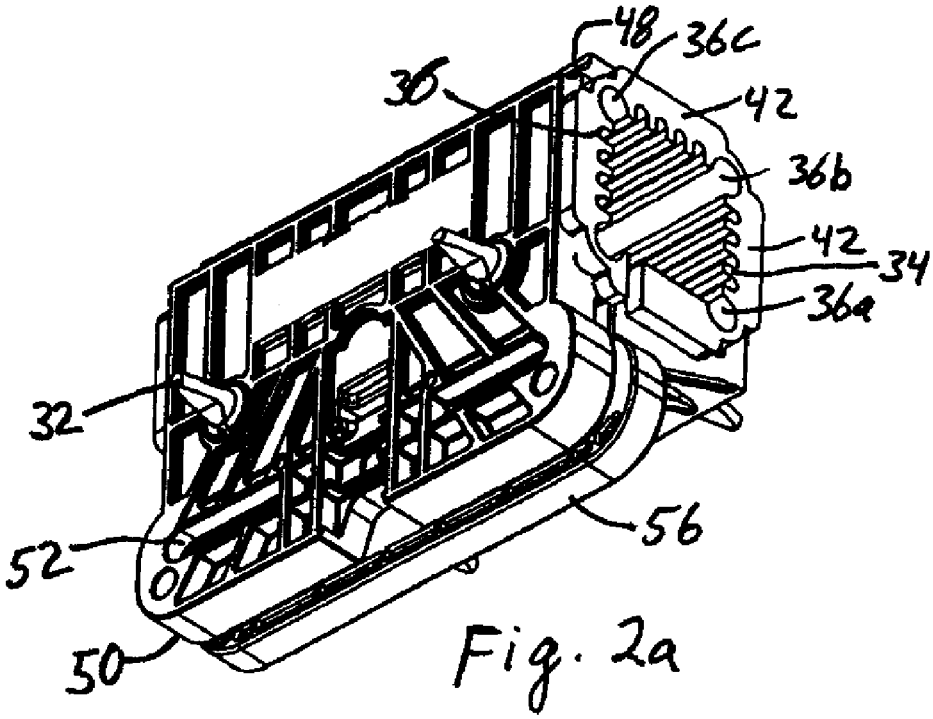
FIGS. 2*a* and 2*b* are bottom and top perspective views, respectively, of the bracket of FIG. 1 without a support bar.
Figure 2B:
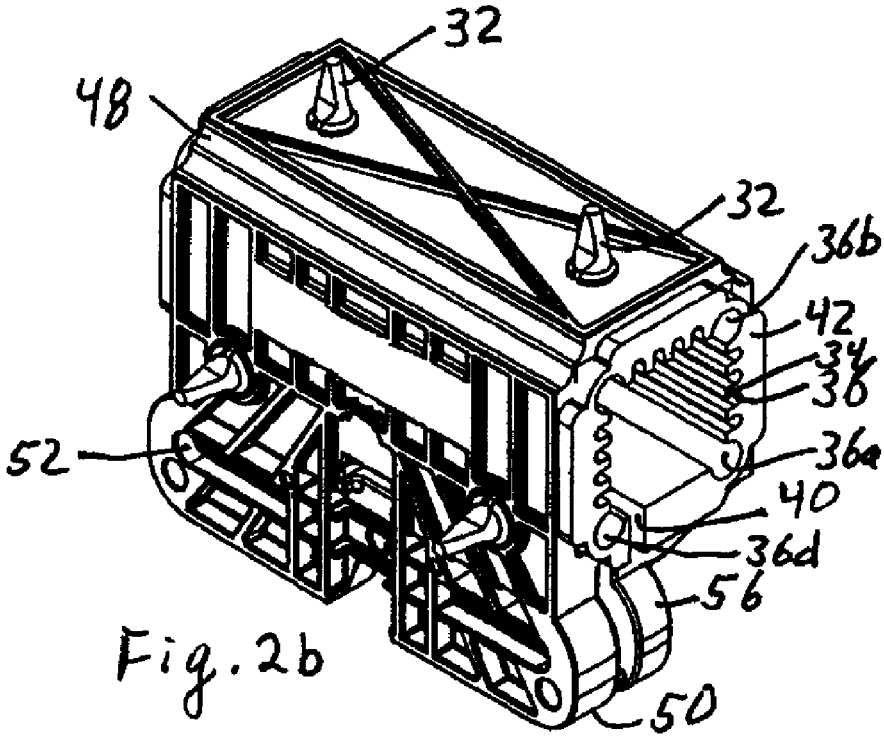
Figure 3A:
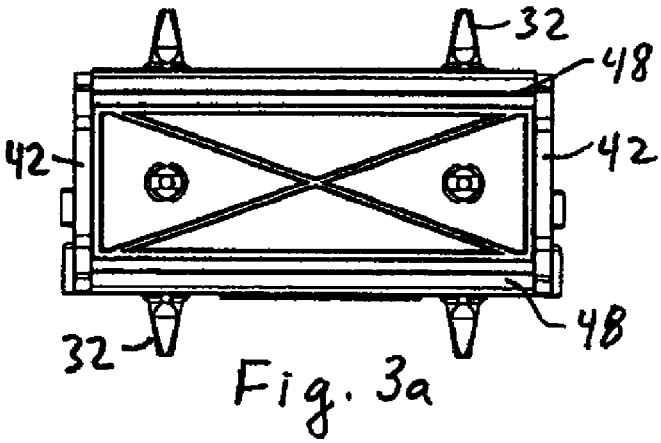
FIG. 3*a* is a top plan view of the bracket of FIG. 2*a;*
Figure 3B:
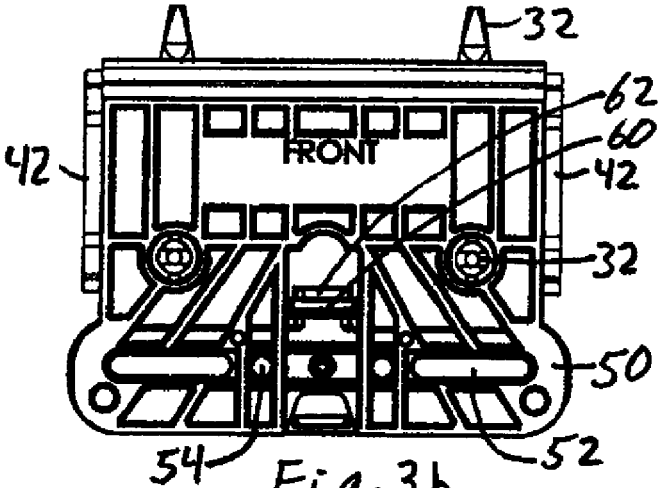
FIG. 3*b* is a front plan view of the bracket of FIG. 2*a;*
Figure 3D:
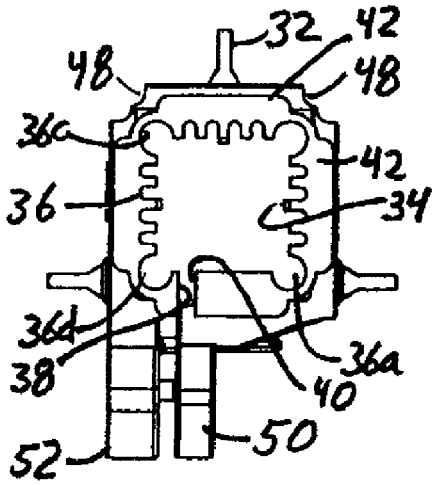
FIG. 3*d* is a bottom plan view of the bracket of FIGS. 2*a* and 3*b;*
Figure 3C:
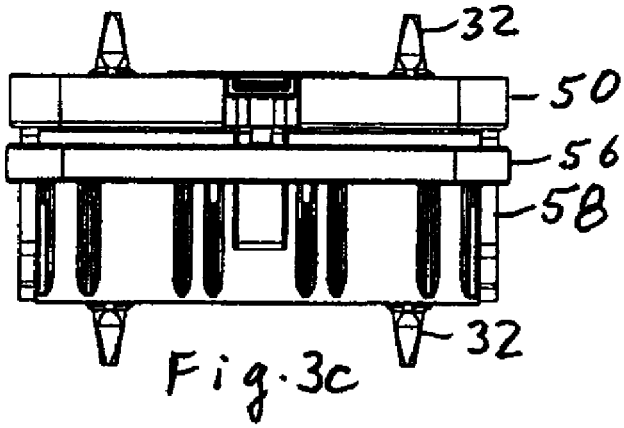
FIG. 3*c* is a side plan view of the bracket of FIGS. 2*a* and 3*b;*

Referring to FIGS. 1-6, a shower bracket 20 has a resilient isolator 22 encased by a stiff shell 24, both of which are wrapped around a support 26. A water pipe 28 (FIG. 1) is fastened to the shell 24 by threaded fasteners 30, with a shower head 31 on the end of a shower head pipe 33 which is typically threaded into an outlet end of an eared elbow fitting 27 (FIG. 1). The eared fitting 27 has its inlet fastened to water pipe 28, typically by soldering. Fasteners 30 pass through the ears on the eared fitting 27 to fasten the eared fitting to the bracket 20 and thus to the support 26. The support 26 typically extends between studs of a building and is preferably an adjustable length support of the type disclosed in U.S. Pat. No. 6,519,791, the complete contents of which are incorporated herein by reference. This patent show an adjustable supports 26 having an outer channel (part 80 in FIG. 1 hereto) and inner channel (part 78 in FIG. 1 hereto) each having complementary shapes so the inner channel nests inside and slides within the outer channel in order to change the length of the support, as for example, to extend between adjacent studs in a building. The ends of the support 26 are adapted to fasten to the studs. The support 26 is typically made of metal and thus readily conducts acoustic vibrations to the building to which the support is fastened. The depicted support 26 has a rectangular cross-sectional shape with a generally square cross-sectional shape being preferred.

Figure 4A:
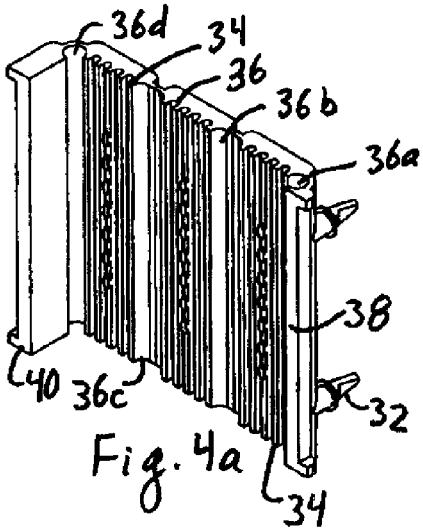
FIGS. 4*a* and 4*b* are top and bottom perspective views, respectively, of an isolator as used in FIG. 1 but with the isolator in a generally flat position and with the isolator oriented vertically.
Figure 4B:
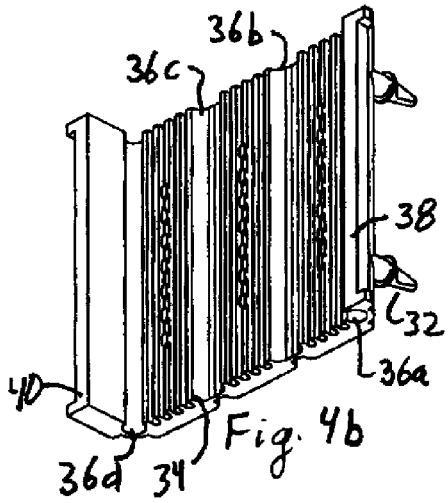
Figure 4C:
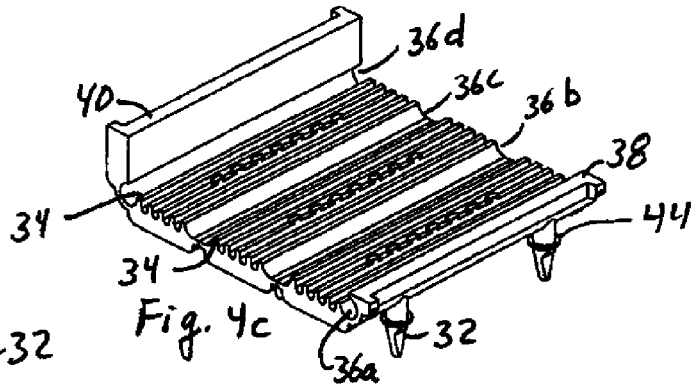
FIG. 4*c* is a top perspective view of the isolator of FIG. 4*a* with the isolator generally horizontal and showing the inner or interior side of the isolator.
Figure 4D:
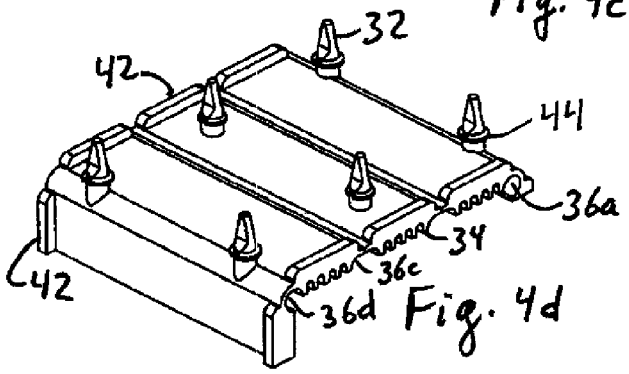
FIG. 4*d* is a top perspective view of the isolator of FIG. 4*a* with the isolator generally horizontal and showing the outside or exterior side of the isolator.
Figures 5A, 5B, 5C, 5D, 5E, 5F, 5G:
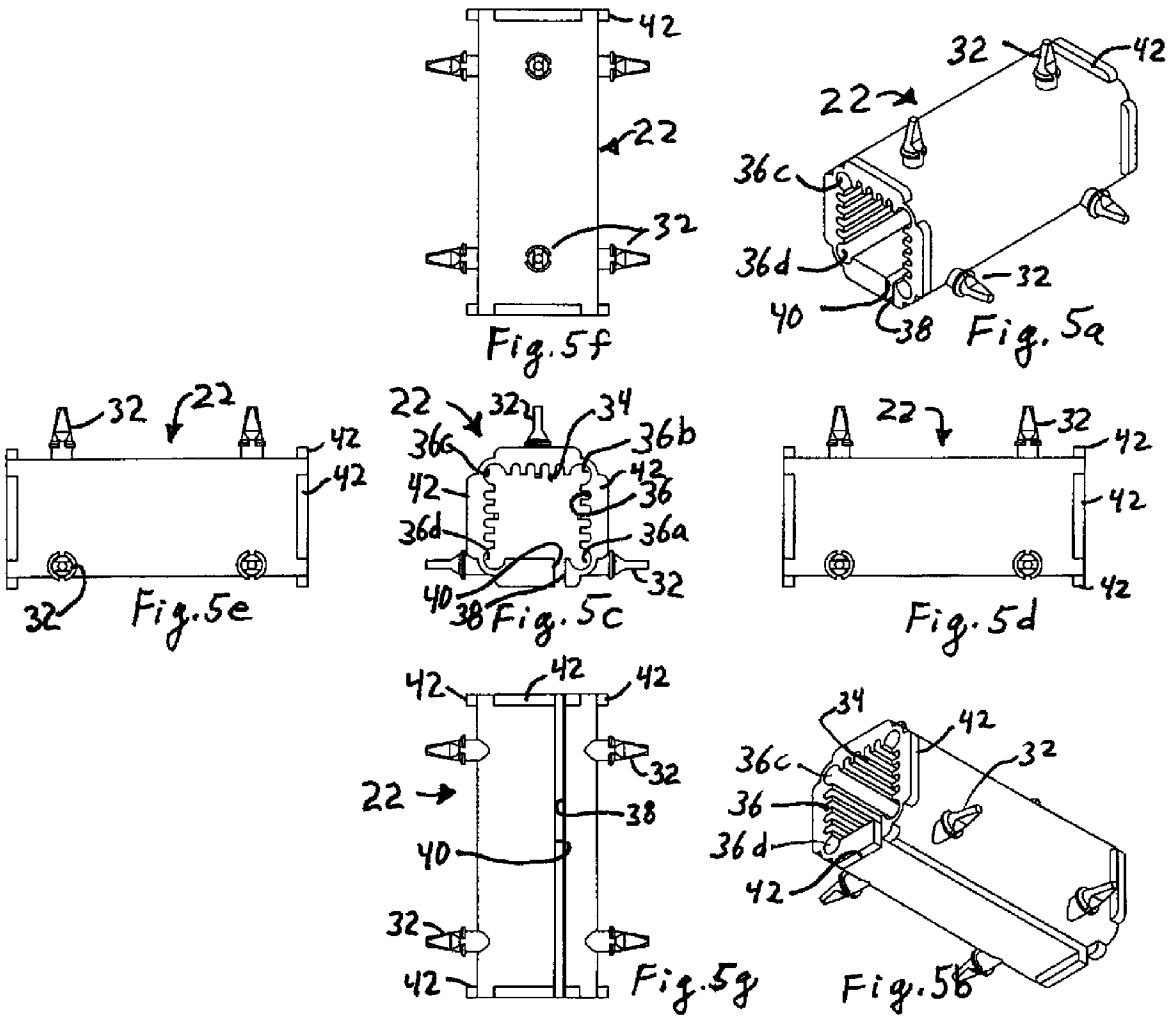
FIGS. 5*a* and 5*b* are top and bottom perspective views, respectively, of the isolator used in FIG. 1 with the isolator oriented as used in FIG. 1.
FIG. 5*c* is an end plan view of the isolator of FIG. 5*a;*
FIG. 5*d* is a right side plan view of the isolator of FIG. 5*c;*
FIG. 5*e* is a left side plan view of the isolator of FIG. 5*c;*
FIG. 5*f* is a top plan view of the isolator of FIG. 5*c;*
FIG. 5*g* is a bottom plan view of the isolator of FIG. 5*c;*
Figures 6A, 6B, 6C, 6D, 6E, 6F, 6G:
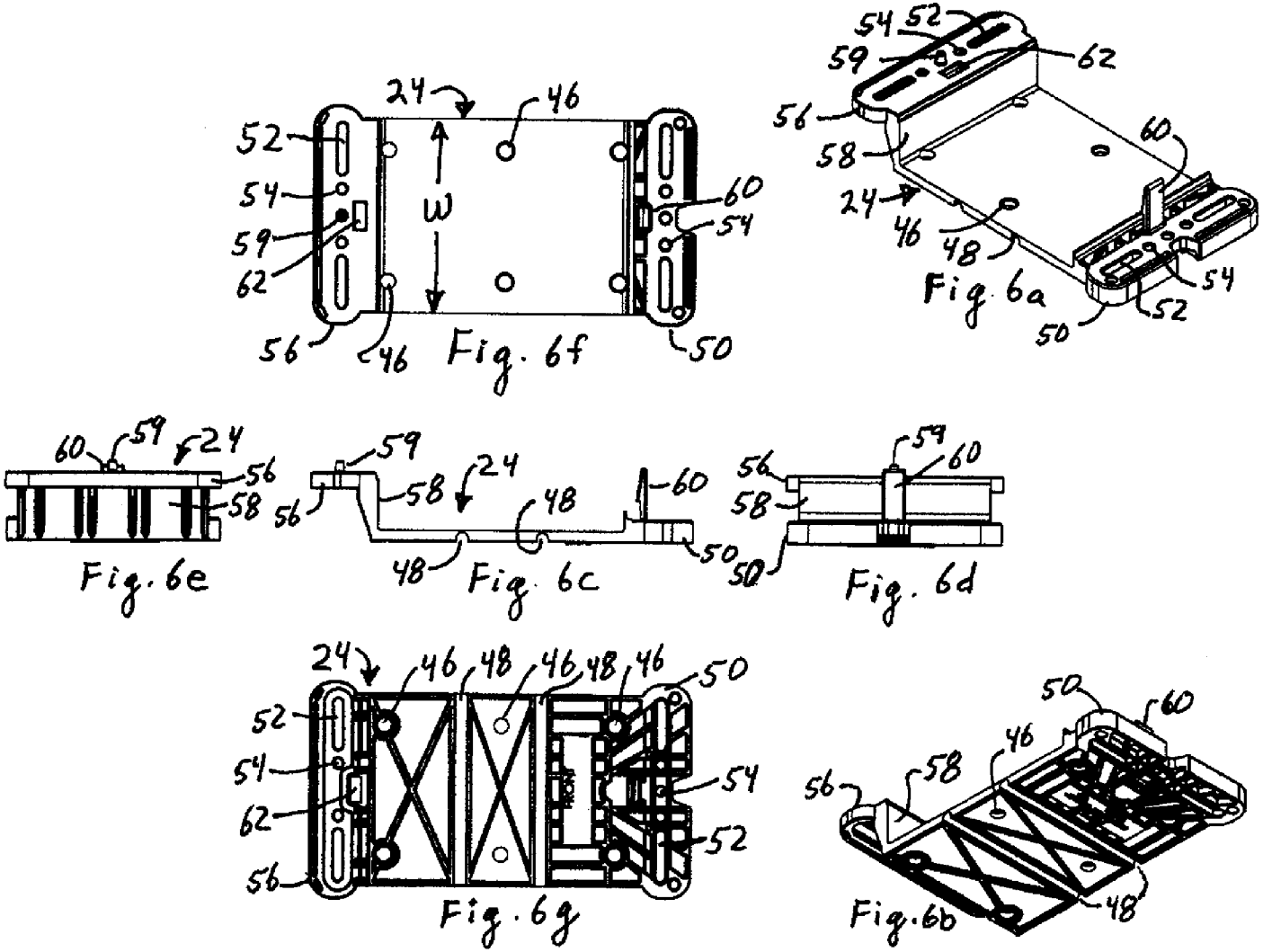
FIGS. 6*a* and 6*b* are, respectively, top and bottom perspective views of the shell portion of the bracket of FIG. 1, but with the shell in a generally flat position.
FIG. 6*c* is a front plan view of the shell of FIG. 6*a;*
FIG. 6*d* is a right side plan view of the shell of FIG. 6*c*
FIG. 6*e* is a left side plan view of the shell of FIG. 6*c;*
FIG. 6*f* is a top plan view of the shell of FIG. 6*c;*
FIG. 6*g* is a bottom plan view of the shell of FIG. 6*c;*
Figure 7A:
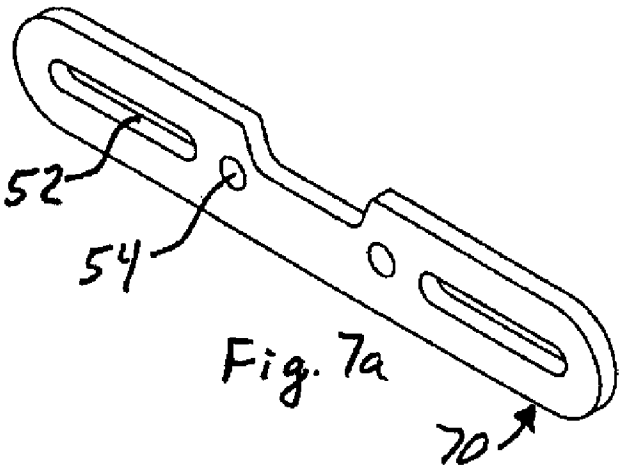
FIG. 7*a* is a perspective view of a strengthening insert used in the shell of FIGS. 6*a*-6*f;*
Figure 7C:
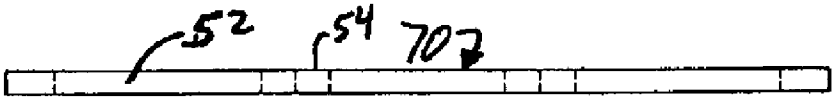
FIG. 7*c* is a top plan view of the insert of FIG. 7*b;*
Figure 7B:
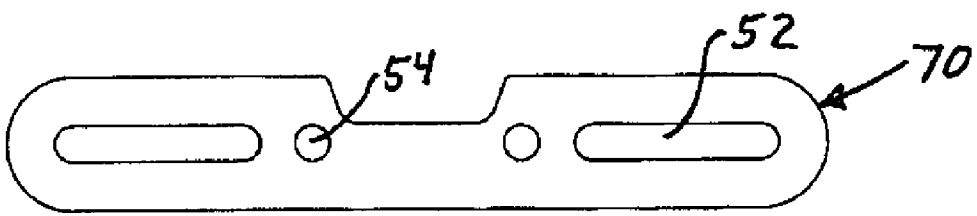
FIG. 7*b* is a front plan view of the insert of FIG. 7*a;*
Figure 7D:
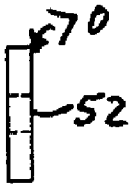
FIG. 7*d* is a left side plan view of the insert of FIG. 7*b*, with the opposing view being the same.
Figures 8A, 8B, 8C, 8D, 8E, 8F, 8G:
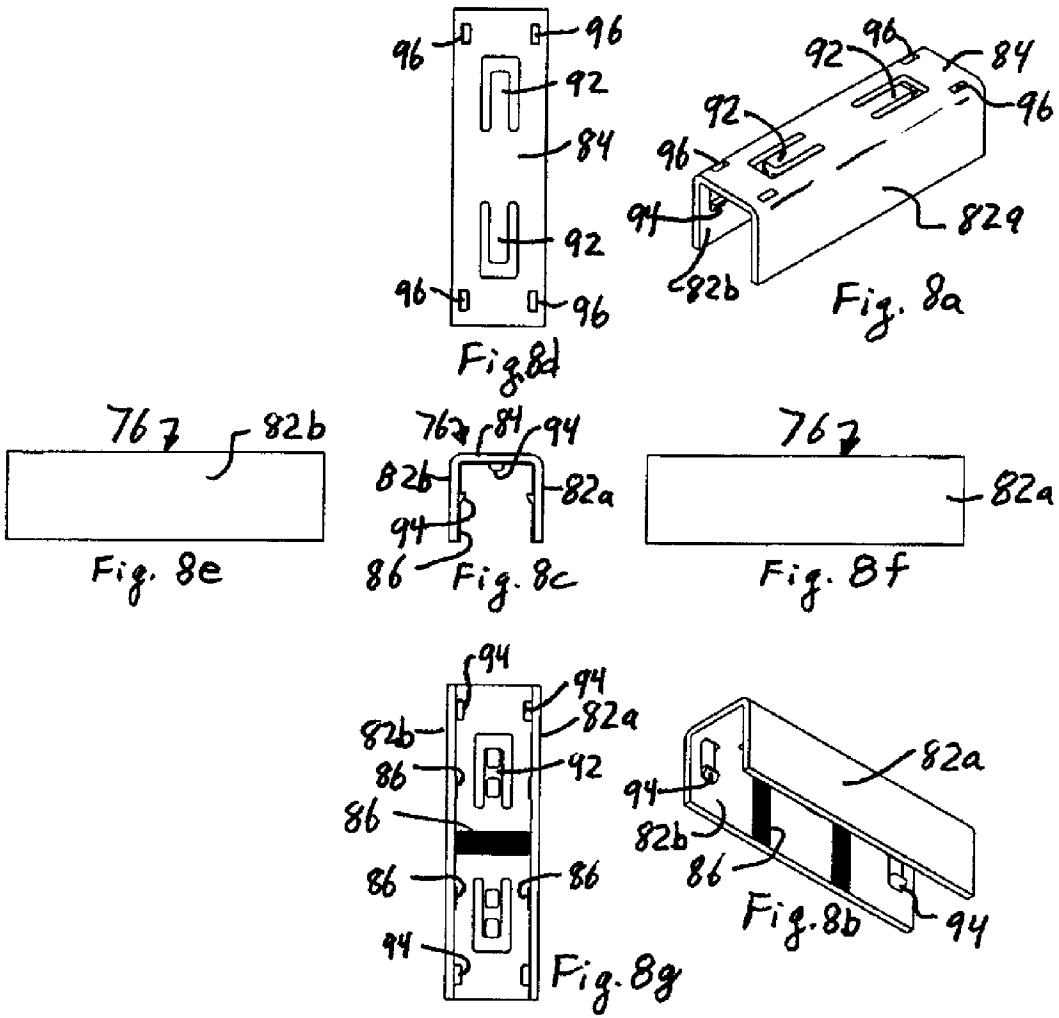
FIGS. 8*a* and 8*b* are top and bottom views, respectively, of an adaptor for use with the support bar of FIG. 1.
FIG. 8*c* is an end plan view of the adaptor of FIG. 8*a;*
FIG. 8*d* is a top plan view of the adaptor of FIG. 8*c;*
FIGS. 8*e* and 8*f* are left and right side plan views, respectively, of the adaptor of FIG. 8*c;*
FIG. 8*g* is a bottom plan view of the adaptor of FIG. 8*c;*
Figure 9A:
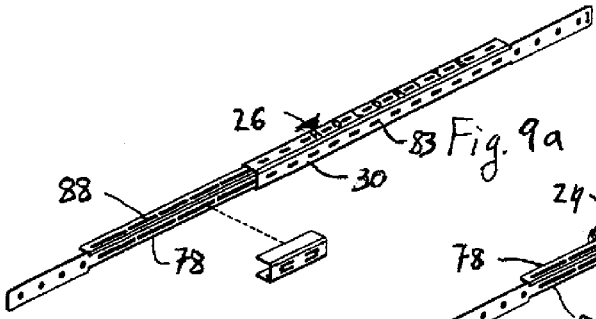
FIG. 9*a* is a perspective view of the adaptor of FIGS. 8*a*-8*f* on a support member.
Figure 9B:
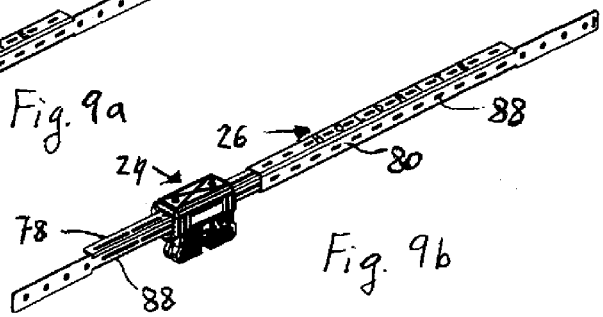
FIG. 9*b* is a perspective view of the bracket of FIG. 1 on the adaptor of FIG. 9*a;*
Figure 10:
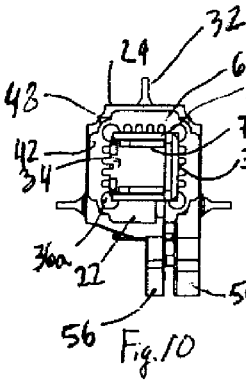
FIG. 10 is an end view of the support member, bracket and adaptor of FIG. 9*b*.
Figure 11:
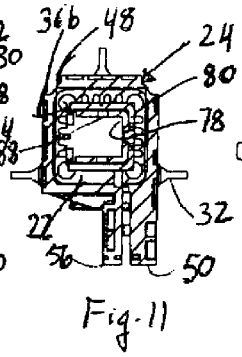
FIG. 11 is a sectional view taken along 11-11 in FIG. 9*c*.
Figure 9C:
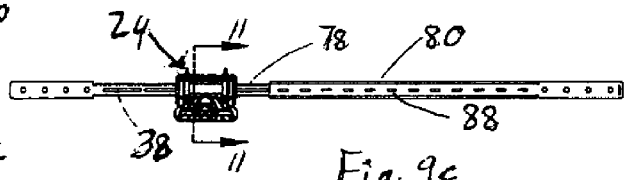
FIG. 9*c* is a plan view of the bracket and support of FIG. 9*b;*

Referring to FIGS. 4-5, the isolator 22 comprises a piece of acoustic dampening material interposed between the shell 24 and the support 26. The isolator preferably comprises a rectangular strip of material such as rubber, TPR (thermo plastic elastomer), vinyl, resilient polymer, or any other suitable material that substantially reduces vibration and noise transmission while supporting the forces applied during the life of the bracket with little resulting relative motion between the shell and isolator. If a user pulls on the showerhead 31 the bracket 20 should seem secure and not loose. A tight clamp is thus preferred and is one that results in little relative movement between the shell 24 and support bar 26 where the little relative movement is less than about 0.03-0.05 inches measured at the ends of the shell and perpendicular to the faces of the support bar 26, and that also restrains movement along the length of the support bar 26. Substantially reducing the vibration and noise transmission refers to a reduction of about 50% or more, advantageously a reduction of about 75% or more, and preferably a reduction of about 90% or more in that the magnitude of outgoing vibrations are about 90% less than the vibrations at the shower eared fitting 27 fastened to the bracket 20.

The isolator 22 preferably has a generally square or rectangular shape with fasteners such as prongs 32 on a first, outer side of the isolator. A plurality of ridges or ribs 34 and grooves 36 are formed on an opposing second side which forms the inside of the isolator during use. The ribs 34 can be of uniform height or variable height. The isolator has four larger corner grooves 36*a*, 36*b*, 36*c*, 36*d* located to correspond with the corners of the isolator 20 and the corners of the support member 26. The corner grooves 36*a*-36*d* define fold lines or weakened lines forming hinges about which the isolator more readily bends to wrap around the support bar 26. The first groove 36*a* is formed adjacent one end 38 of the isolator. The ribs 34 and grooves 36 preferably run the entire distance between opposing sides of the isolator 22. Preferably, but optionally, there are five ribs 34 between each of the adjacent corner grooves 36*a*-36*b*, 36*b*-36*c*, 36*c*-36*d*. Optionally, the thickness of the isolator between groove 36*d* and an adjacent end 40 is of uniform thickness and about the same as the thickness at ribs 34.

The surface of the isolator 22 opposite the ribs 34 contains the fasteners 32. A flange 42 extends outward from the sides of the isolator along the edges extending between ends 38 and 40. The flange 42 can be continuous or intermittent and is shown as having four segments located to correspond with each of the flat sides of support 26, so that there are eight flanges 42.

The fasteners or prongs 32 can take various shapes but preferably take the form of elongated prongs having a tapered end with a retainer or latch 44 (FIGS. 4*c* and 4*d*). The depicted prongs 32 are circular in cross-section with conical ends, but the shape could vary, including rectangular cross-sections with barbs for latches 44. The prongs 32 are preferably located by the flanges 42, and the illustrated embodiment shows six prongs 32.

In use, the isolator 22 wraps around the support 26 with the ribs 34 abutting the optionally flat sides of the support and with grooves 36*a*, 36*b*, 36*c* and 36*d* helping the isolator to fold at the corners of the support bar 26. The prongs 32 are located so two prongs are on the top of the support 26 and two prongs on each of the sides of the support.

Referring to FIGS. 1, 2*a*-2*b*, and 6*a*-6*g*, the shell 24 is described. The shell 24 abuts at least a portion of the outside of the isolator 22 and preferably abuts a substantial portion of the isolator to clamp it against the support bar 26. The shell 24 preferably has a central portion matching the shape of the isolator so the shapes substantially overlap. The depicted shell 24 has a generally flat, rectangular shape with a width W (FIG. 6*f*) that is slightly less than the distance between flanges 42 on the isolator. The shell has optional recesses 46 located to receive prongs 32 and shaped to engage the latch 44 on the prongs to retain the mating prongs 32 in connection with the recesses 46. There are thus six recesses, preferably aligned in pairs of recesses, with each recess adjacent an edge of the shell. The projections and recesses form one type of interlocking fastener or snap-lock fastener that fasten the isolator 22 to the shell 24 to restrain relative movement between those two parts.

The shell 24 is of stiff material that is sufficiently strong to transmit forces from the shower to the support 26 without substantial movement or deformation that would cause a user to question the security of the support for the shower 31 and water pipe 28. A shell made of polyethylene, high density polyethylene, polyvinylchloride or Nylon is believed suitable. The shell 24 clamps to the support 26 and thus has a generally U-shaped cross-section with a top and two legs, with the legs being urged together to clamp the shell 24 to the support 26. The shell 24 can take various shapes and still fit over the support 26 and have its opposing legs clamped together. Preferably, the shell 24 conforms to the shape of the support 26, and preferably the support 26 has a rectangular (e.g., square) cross-sectional shape. The preferred shell 24 will be described for the preferred shape of support 26, but the invention is not limited to the described shapes.

Two grooves 48 extend across the width of the shell 24, with the grooves located to correspond with the top corners of the support 26 as the shell wraps around the support. The grooves 48 define weakened lines or flexure lines or hinges along which the shell 24 folds or bends or hinges to wrap around the support 26. The grooves 48 are thus spaced apart a distance corresponding to the width of the support 26 or slightly greater to accommodate for the thickness of the isolator 22. The grooves 48 are preferably located in the exterior side of the shell 24 so the grooves open during use, but this is optional. Depending on the cross-sectional shape of the support 26 the number of grooves 48 will vary. The shell 24 may have stiffening ribs, preferably on the exterior surface. Any ribs or other features on the interior surface of the shell 24 preferably mate with corresponding recesses or mating features on the outer, abutting surface of the isolator 22 to further ensure there is little or no relative movement between the more flexible isolator 22 and the stiffer shell 24.

At a first end of the shell 24 is a fastener plate 50 which is preferably, but optionally, in the same general plane as the portion of the shell containing the recesses 46. Elongated slots 52 are formed the fastener plate 50 and extend along a line across the width W of the shell. Additional apertures 54 can be formed in the fastener plate 50 as desired.

The opposing end of the shell 24 has an end 56 which is urged toward end 56 to clamp the shell 24 onto the support 26. The end 56 could be adjacent a groove 48 located to allow the shell to bend around the bottom of the support 26. But preferably the end 56 is offset by flange 58 from the plane of the shell containing the recesses 46 and fastener plate 50. The end 56 thus extends generally perpendicular to the adjacent portion of the shell 24. The offset end 56 is generally parallel to the plane of the shell containing the recesses 46 and fastener plate 50 when the shell is flat. The offset flange 58 is selected to place the end 56 adjacent the fastening plate 50 when the shell is wrapped around the support 26. The offset flange 58 could be omitted. Slots 52 and apertures 54 are optionally formed in the offset end 56 and are preferably, but optionally located to align with the slots and apertures in the fastener plate 50. An optional alignment projection, such as peg 59 (FIGS. 6*a* & 6*c*) can be provided in end 56 or fastener plate 50 to mate with a corresponding recess in the other part.

As seen in FIGS. 6*a*-6*g*, one end of the shell 24 has a male projection 60 and the other end has a mating female recess 62 (FIG. 6*a*) located and shaped to engage the male projection 60 and provide a means or mechanism for holding the ends 50, 56 together and for clamping the shell 24 onto the support 26. The projection 60 and recess 62 form portions of a snap-lock connection that preferably does not tightly clamp the shell 24 to the support 26, but rather provides a loose clamp that allows sliding of the bracket 20 along the length of the support 26 to make positioning and adjustment easier. The depicted projection 60 has a rectangular cross section with a barb that is received in rectangular recess 62 having ledge that engages the barb to releasably fasten the fastener plate 50 and offset end 56 together. Other shapes and types of snap-lock fittings could be used.

Referring to FIGS. 1-3, for use the isolator 22 is interposed between the support 26 and the shell 24. Preferably this is achieved by releasably or permanently fastening the isolator 22 to the shell 24 before wrapping the assembled parts around the support 26. The flanges 42 preferably fit on the outside of the sides of the rectangular portion for the shell 22 for easy alignment, although the flanges could be omitted. The isolator is fastened to the shell by aligning the prongs 32 with the recesses 46 and engaging those parts. The internal prongs 32 preferably extend through the recesses 46 sufficiently to engage latches 44 with the projecting prongs 32 showing the presence of and engagement of the isolator 22 which is enclosed in the shell 24. Of course the shell 24 could have openings or be sized or shaped differently than the isolator 22 in order to visibly display the presence of the isolator. The connection between the shell 24 and isolator 22 can be releasable or permanent. The prongs and recesses could be omitted entirely and the isolator 22 fastened to the shell 24 by other means. Adhesive materials could be used in addition to or in lieu of the prongs and recesses to fasten the parts together either permanently or releasably. The shell 24 could be over molded onto the isolator 22. It is desirable to fasten the isolator 22 to the shell 24 so that an installer can slide the shell 24 along the support 26 for positional adjustment of the showerhead 31 or pipe 28, and have the isolator 22 move with the shell. Fastening the isolator 22 to the shell 24 also prevents misalignment of the isolator relative to the shell or the support 26. But the shell 24 and isolator 22 could be separate parts not held together until the shell is clamped tightly onto the support 26.

When the isolator 22 wraps around the support 26, the grooves 36*a*, 36*b*, 36*c* and 36*d* face the corners of the support 26 and define a weakened line for folding or flexing of the stiff shell 24. The ribs 34 abut the support 26 and allow resilient contact with the support as the ribs can deform or bend because of the grooves along the ribs. The ribs and grooves are optional, but are preferred because they are believed to increase the damping of vibrations transmitted to the support 26.

When the isolator 22 and shell 24 wrap around the support 26, the fastener plate 50 aligns with the offset end 56 and preferably those parts are abutting each other or very close to each other. Alignment peg 59 is provided and mates with a corresponding aperture 54 to align the parts. Of course, the alignment peg 59 and latch 60 are optional, but preferred because they make assembly more reliable and easy.

The amount of offset provided by flange 58 can adjust the closeness of the fit between fastening plate 50 and offset end 56 and thus vary the clamping force. The end 56 and plate 50 are preferably sufficiently close so that the male projection 60 engages the recess 62 to temporarily latch the parts together, thus freeing the user's hands to further adjust and fasten the bracket to the water pipe. Threaded fasteners 30 can pass through the eared fitting 27 connected to the water pipe 28 and further pass through the aligned slots 52 to fasten the water pipe 28 to the fastener plate 50 and or offset end 56. One or more of the fasteners 30 thus provide a means and mechanism for holding the plate 50 and end 56 together and for clamping the shell 24 onto the support 26. Alternately, because the plate 50 is on an end of the shell, the fasteners 30 fasten the opposing ends of the shell together to clamp the shell against the isolator 22 and support bar 26. Further, by connecting the fastener plate 50 and offset end 56 using threaded fasteners 30, the shell 24 is more securely fastened around the support 26 and effectively clamped around the support as the plate 50 and end 56 are brought together. The stiff shell 24 is tightened or clamped around the isolator 22 to provide a suitably tight connection as described above.

While threaded fasteners 30 engage apertures 54 or slots 52 in the ends 50, 56 to draw the ends toward each other and clamp the shell 24 onto the support 26, other fastening mechanisms could be used, including various clamps to hold the ends 50, 56 together. The shell 24 is sized so it clamps onto the support 24 and compresses the isolator 22 to restrict relative movement, and that requires the parts between the fastening mechanisms be sized relative to the adjacent portions of the support 26 and isolator 22 to provide that tight, clamp connection. The size of the shell 24 will vary with the thickness of the isolator 24 and the amount of compression to which the isolator 24 can be subjected. The size of the shell 24 will also vary depending on the type of fastening mechanism used to connect ends 50, 56, especially as the offset 58 can be omitted. In its simplest form, a shell 24 having a U-shaped cross-section sized to fit over the support bar 26 and isolator 22 could be used with the legs of the shell being clamped together. But that would not engage the bottom part of the support 26 and may not enclose the bottom of the support 26, so preferably the shell 24 has offset 58 or has an additional fold line 48 so the shell 24 has a portion substantially parallel with each of the sides of the support 26. For the depicted support 26 with a rectangular cross-section the shell 24 has a top, opposing sides and a bottom aligned with the corresponding parts of the support 26. One portion of the shell 24 is longer than the adjacent side of the support 26 to form an end 50 extending beyond the adjacent side of the support 26 and the opposing end of the shell has an end 56 oriented to face the end 50 and allow them to clamp together. But other fastening mechanisms could be used.

As seen best in FIG. 1, the water pipe 28 connects to an elbow with flanges forming an eared fitting 27. The eared portion 27 has holes that overlap with the slots 52 in the fastener plate 50, so the pipe 28 and adjacent showerhead 31 that are fastened to the fitting 27 is also fastened to the bracket 20. The end or mounting portion 50 forms a mounting portion to fasten to the fitting 27.

As water passes through the pipe 28 any vibration through the fasteners 30 or other connection with the shell 24 is isolated from the support 26 by the isolator 22. The wrap-around and clamping construction of the shell 24 and isolator 22 allow the bracket 20 to be readily positioned along the length of the support 26, with the fastening of the pipe to the fastener plate 50 and offset end 56 clamping the shell to the support 26 to fix the position. The slots 52 are preferably about the same size as or slightly smaller than the root diameter of threaded fastener 30 so the fastener 30 screws into the slots 32. In this way a nut is not necessary on the end of the threaded fastener 30—but a nut is still preferred.

Referring to FIGS. 1-2, 6*a*-6*g* and especially to FIG. 7*a*-7*d*, the fastener plate 50 is preferably formed by over-molding the shell 28 onto an elongated metal or strong plastic plate 70. The plate 70 is formed with the slots 52 and apertures 54 in the plate, or the slots and apertures are cut into the plate before or after the plate is over-molded to form part of the shell. This over-molding allows a strong attachment point on the shell 22. The plate 70 could be made of a softer metal than the threaded fastener 30, such as softer steel, aluminum or brass, so that the threads on the fastener cut grooves into the metal plate 70 as the fastener is threaded through the slots 52, thus providing a strong connection to the metal plate 70. Alternatively, the plate 70 could be made of any suitable metal with the threaded fastener 30 engaging the plastic shell, or engaging only a receiving nut on the opposite side of the bracket 20.

In use, the flat isolator 22 is fastened to the shell 24 to form bracket 20. The bracket 20 is positioned over the desired portion of support bar 26 and bent at the fold lines to wrap around the support bar. The latch 60 engages the mating recess 62 to loosely hold the bracket in place while allowing the user to use both hands and while allowing the bracket to be slid along the length of the support bar to adjust the position. Screws or bolts 30 move the spaced-apart fastener plate 50 and end 56 together to squeezes isolator against the support bar and thus clamp the parts in place. Preferably, but optionally, the fasteners 30 also pass through eared fitting 27 so the showerhead 31 is effectively fastened to the bracket 20 while the bracket 20 is clamped to the support bar 26 sufficiently tight to substantially reduce relative movement of the shell 24 and support bar 26 and to substantially reduce transmission of noise and/or vibrations from the water pipe 28 to the support bar 26. Alternatively, the isolator 22 could be wrapped around the support bar 20 and the shell wrapped around the isolator with the ends 50, 56 held together to clamp the shell and isolator against the support bar 26.

There is thus provided a method and mechanism for adjustably positioning a clamping bracket 20 along a support 26 to fasten a water pipe 28 to the support. There is further provided a method and mechanism for reducing the transmission of vibrations from the water pipe 28 to the support by fastening the water pipe to a shell 24 while interposing an isolator 22 between the shell and the support 26 to reduce transmission of vibrations to the support and the building.

Referring to FIGS. 1 and 8-11, an adaptor 76 is shown for use when the support 26 has an inner segment 78 (FIGS. 1 & 9) that is smaller than the outer segment 80 and the bracket 20 is fastened to or over at least part of the smaller, inner segment 78. The adaptor 76 fits onto the inner segment 78 so the outer surface of the adaptor aligns with the outer surface of the outer segment 80. That allows the isolator to abut against a uniformly sized support 26.

The adaptor 76 is an elongated segment with a U-shaped cross section formed by two legs or side panels 82*a*, 82*b* joined along a top portion 84. The adaptor 76 is sized to fit over the inner segment 78 and preferably to snugly fit over the inner segment. One or more strips of friction material 86 is placed on the inside of the adaptor 76, between the adaptor 76 and the support 26. The friction material 86 preferably comprises a roughened surface extending across both sides 82*a*, 82*b* and the top 84 on the inside of the adaptor 76. A series of ridges or randomly roughened material are believed suitable for friction material 86. A strip of rubber or elastomer could also be provided to form the friction material 86.

The adaptor 76 could be adhesively fastened to the support 26, but preferably mechanical fasteners are used with or instead of the adhesive. The support 26 has a series of holes 88 (FIGS. 1 & 9) on the sides and top of the support bar 26. One or more latches 90 are formed on the top 94 and sides 82*a*, 82*b* of the adaptor 76. The latch 90 on the top 84 preferably comprises a cutout forming an elongated member 92 with one or more barbs 94 on the end and along the length of the member 92, with the barbs extending toward the interior of the adaptor. The barbs 94 engage the holes 88 in the top of the inner support 78. The latch 90 on the sides 82 preferably comprises a barb 94 extending toward the inside of the adaptor. The latch 90 on the sides 82 is made by forming a hole 96 in the top 84 adjacent the sides 82*a*, 82*b* and deforming a portion of the inner side wall to form barb 94 which extends toward the inside of the adaptor 76. The barb 94 engages one of the holes 88 in the inner support 78 to hold the adaptor to the inner support 78.

In use, the adaptor 76 is placed on the inner support 78, the bracket 20 is positioned over some or all of the adaptor, and the bracket is fastened to the support. Clamping the fastener plate 50 to the offset end 56 will squeeze the adaptor 76 against the inner support 78 while providing an outer surface on the support 26 having a substantially uniform size—at least on three sides. There is thus advantageously provided a mechanism and method for providing a uniform engaging surface on the support 26 for uniformly supporting the isolator 22 of the bracket 20.

The shell 24 is preferably, but optionally about 3-4 inches long and about ⅛-¼ inch thick for use with water pipes of ½-1 inch diameter. For that application, the isolator 22 is about 1/32 to ⅛ inch thick, preferably about 1/16 inch thick, and made of thermo plastic resin or elastomer with a hardness of about 40-60 shore, and more preferably a hardness of about 50-60 shore. As the hardness increases the transmission of higher frequency noise increases. If low frequencies dominate then the material hardness can be higher, even exceeding 60 shore. As the hardness decreases the material is more likely to degrade under pressure applied by the weight transmitted through the isolator 22. The dimensions of the shell 24 and isolator 22 will vary according to the size of the pipes involved and according to the amount of vibration anticipated. The thickness of the isolator 22 and or the height of the ribs 34 can be varied to accommodate different diameter water pipes 28, but preferably a different sized isolator and shell are provided for standard sized water pipes which vary from about ⅜ inch to 5/4 inch or larger.

The above description is given by way of example, and not limitation. Given the above disclosure, one skilled in the art could devise variations that are within the scope and spirit of the invention disclosed herein, including various ways of using the bracket 20 with various water pipes other than shower heads 31 or using the bracket to reduce the transmission of vibrations from other conduits fastened to the bracket 20. Moreover, while various specific fasteners such as prongs 32 and recesses 46 are described, any fastener could be used, including various snap-lock mechanisms—both releasable and permanent. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A shower mounting bracket for connecting an eared fitting connected to a shower head and water pipe to an elongated support bar having a generally rectangular cross-section with a top and sides and four corners, the support bar extending between studs of a building, the bracket comprising:

a stiff outer shell having a body portion with sides long enough to extend around and along the top and sides of the support bar during use of the bracket and having first and second ends at least one of which has first openings therein located in a mounting portion, the mounting portion configured to fasten to the eared fitting during use with the first openings further located to receive threaded fasteners extending through the eared fitting during use of the bracket, the shell having three segments separated by two reduced thickness fold lines with the distance between the fold lines predetermined so that each of the fold lines is located at one of the corners during use of the bracket;

an isolator sized to fit between the body portion and the support bar during use and made of a material that substantially reduces the transmission of sound;

a mechanism fastening the ends together with the shell being sized slightly smaller than the adjacent support bar and intervening isolator so that when the ends are fastened together the isolator can be tightly clamped to the support.

2. The mounting bracket of claim 1, wherein the shell has sides generally parallel with each side of the support and the ends are generally parallel with each other during use.

3. The mounting bracket of claim 1, further including a releasable latch to hold the first and second ends together.

4. The mounting bracket of claim 1, further including a male portion of a snap lock located on one end and a female portion of a snap lock located on the other end, the male and female portions being located to align and releasably engage during use to loosely hold the bracket in position relative to the support.

5. The mounting bracket of claim 1 wherein the isolator is fastened to the shell to restrain relative movement of the isolator and shell.

6. The mounting bracket of claim 1, wherein the isolator and shell have different mating parts of a snap lock comprising at least one projection and at least one recess located to engage to hold the isolator in position relative to the shell.

7. The mounting bracket of claim 1, further comprising a plurality of ribs on an inside surface of the isolator.

8. The mounting bracket of claim 1, wherein the first end has a metal insert with at least one slot located to receive a threaded fastener passing through the eared fitting.

9. The mounting bracket of claim 4, wherein the first end has a metal insert with at least one slot located to receive a threaded fastener passing through the eared fitting.

10. The mounting bracket of claim 1, wherein the first end has a metal insert over molded with plastic with two spaced apart slots each located to receive a different threaded fastener passing through the eared fitting, and wherein the second end has two slots located to align with the slots in the first end.

11. The mounting bracket of claim 1, wherein the first segment of the shell comprises a substantially flat sheet of material containing the first end, and wherein the third segment includes a substantially flat sheet of material with the second end being orientated perpendicular thereto.

12. The mounting bracket of claim 11, further comprising a male portion of a snap-lock located on one end and a female portion of a snap lock located on the second end with the portions of the snap lock being located to engage during use and hold the ends loosely together.

13. A mounting bracket for connecting a water pipe fastened to an eared fitting to a support bar in a building, the support bar having a cross-section with four sides and four corners, comprising:

an isolator made of a material selected to substantially reduce the transmission of noise and having a length sufficient to wrap around the support bar;

a stiff shell sized to wrap around a periphery of the support bar and having two ends configured to form a mounting portion for the eared fitting, the shell being sized to clamp the isolator against the support bar during use as the ends are moved toward each other with sufficient force that there is a tight clamp resulting in little relative movement between the shell and the support during use, the shell having three stiff segments joined by two reduced section fold lines with the distance between fold lines being predetermined to locate each of the fold lines along a length of the support bracket at one of the corners of the support bar during use; and a fastening mechanism to hold the ends together.

14. The mounting bracket of claim 13, wherein the support bar has four sides and the isolator has sides long enough to wrap around four sides of the support bar during use and has outwardly extending flanges along at least a portion of each side, and wherein the outer shell has a body portion with sides sized to fit between opposing flanges of the isolator.

15. The mounting bracket of claim 13, wherein the shell has sides with fold lines forming hinges extending from side-to-side and spaced apart a distance sufficient to align with the corners of the support bar during use, the first and second ends being parallel during use.

16. The mounting bracket of claim 13, wherein the fastening mechanism comprises at least one aligned slot in the first and second ends with a threaded fastener extending through the slots.

17. The mounting bracket of claim 13, further comprising a male and female portion of a snap-lock with each portion located on a different end.

18. The mounting bracket of claim 13, wherein the isolator has a plurality of ribs on its internal surface.

19. The mounting bracket of claim 13, wherein the shell and isolator are held together by a plurality of interlocking mechanisms located on the isolator and shell.

20. The mounting bracket of claim 1, wherein the isolator comprises a thermoplastic eleastomer.

21. The mounting bracket of claim 13, wherein the isolator comprises a thermoplastic eleastomer.

22. The mounting bracket of claim 1, further comprising the elongated, support bar having a generally rectangular cross-section with a top and sides and four corners.

23. The mounting bracket of claim 13, further comprising the elongated, support bar having a cross section with four sides and four corners.

* * * * *